US005784811A

United States Patent [19]

Mauch

[11] Patent Number: 5,784,811

[45] Date of Patent: Jul. 28, 1998

[54] SHOE INSOLE

[75] Inventor: Walter Mauch, Klemensplatz 10, W-4000, Düsseldorf 31, Germany

[73] Assignee: Walter Mauch, Dusseldorf, Germany

[21] Appl. No.: 944,103

[22] Filed: Sep. 30, 1997

Related U.S. Application Data

[63] Continuation of Ser. No. 200,306, Feb. 23, 1994, abandoned, which is a continuation of Ser. No. 934,466, filed as PCT/EP91/00493, Mar. 15, 1991, published as WO91/13561, Sep. 19, 1991, abandoned.

[30] Foreign Application Priority Data

Mar. 15, 1990 [DE] Germany ..... 90 02 962.3

[51] Int. Cl.[6] ..... A43B 13/40; A43B 13/38

[52] U.S. Cl. ..... 36/141; 36/43

[58] Field of Search ..... 36/43, 44, 141, 36/88, 91, 92, 71, 140, 145

[56] References Cited

U.S. PATENT DOCUMENTS

| | | | |
|---|---|---|---|
| 2,106,508 | 1/1938 | Shaw | 36/174 |
| 2,852,865 | 9/1958 | Spalding | 36/43 |
| 2,949,685 | 8/1960 | Burns | 36/178 |
| 3,859,727 | 1/1975 | Nakamoto | 36/141 |
| 4,020,570 | 5/1977 | Shames | 36/43 |
| 4,033,054 | 7/1977 | Fukuoka | 36/141 |
| 4,109,661 | 8/1978 | Fukuoka | 36/141 |
| 4,442,612 | 4/1984 | Hauser | 36/71 |
| 4,476,638 | 10/1984 | Quacquarini et al. | 36/44 |
| 4,509,510 | 4/1985 | Hook | 36/44 |
| 4,674,203 | 6/1987 | Goller | 36/141 |
| 4,694,831 | 9/1987 | Seltzer | 36/43 |
| 4,760,655 | 8/1988 | Mauch | 36/141 |
| 4,841,648 | 6/1989 | Shaffer et al. | 36/43 |
| 4,910,882 | 3/1990 | Goller | 36/44 |
| 4,955,148 | 9/1990 | Padilla | 36/43 |

FOREIGN PATENT DOCUMENTS

| | | | |
|---|---|---|---|
| 2619410 | 11/1976 | Germany | 36/141 |
| 3308731 | 1/1989 | Germany . | |

*Primary Examiner*—M. D. Patterson
*Attorney, Agent, or Firm*—Nikaido, Marmelstein Murray & Oram LLP

[57] ABSTRACT

A shoe insole has a flat base-sole corresponding to a shoe contour. The shoe insole is made of a single piece of foam with a Shore hardness A of 30 to 45, and includes a plurality of integral cushion-elevations formed thereupon. Each of the cushion elevations includes an elevation section which gradually increases in thickness from a surface of the base-sole to a peak region which forms a thickest portion of each cushion-elevation. Each peak region includes a flat plateau area which forms a rest surface upon which a foot sole can rest. The peak regions project upward from the base-sole by a thickness which is up to twice the mean thickness of an area of the base-sole adjoining the elevation portions.

21 Claims, 2 Drawing Sheets

SHOE INSOLE

This application is a continuation of application Ser. No. 08/200,306, filed Feb. 23, 1994 abandoned, which is a continuation of application Ser. No. 07/934,466 filed Sep. 15,1992 abandoned.

BACKGROUND OF THE INVENTION

1. Field of the Invention

The invention concerns an insole for a shoe with a flat base-sole made of an elastic foam and corresponding to the shoe contour, said base-sole also comprising on its upper side several integral, cushion-elevations also made of foam and located in the area of the foot-sole reflex zones.

2. Description of the Related Art

An insole suitable for massaging the reflex zones of the foot-sole is known from the German patent 35 08 582. Depending on the arrangement of the elevations, this insole allows stimulating nerves issuing from these reflex zones during the action of walking, as a result of which the blood-supply and the metabolism of the organs associated with the particular reflex zones will be stimulated. The known insole includes a base-sole of elastic foam with a shore hardness A of 30° to 50° and comprising on its top side several cushion-elevations also made of foam and located in the area of the reflex zones that shall be massaged. The cushion-elevations consist of a comparatively soft material with a shore hardness A of 12° to 30°, because it was found that the desired effect of reflex-zone massaging presumes gentle stimulation of the reflex zones. While thought already has been given with respect to the known insertion sole to integrally shape the cushion-elevations into the base-sole, such a procedure on the other hand entails a comparatively complex manufacturing procedure, and in practice as a result the elevations are manufactured separately from the base-sole and then must be subsequently bonded to it. Moreover, the comparatively soft elevations of the known insole must be protected by a harder covering sole to assure adequate life of the insole.

Moreover the U.S. Pat. No. 4,020,570 discloses an insole with an elastic-foam cover sole, which comprises elevations made from the same foam and in the form of a foot-bed. The cover sole is about 6.35 mm thick between the elevations, being of a total height of about 9.5 mm in the area of the elevations. Such an insole is unsuitable is inadequate for optimal reflex-zone massaging because all the foot sinks into the comparatively thick base-sole, and as a result controlled stimulation of specific reflex zones of the foot-sole will be prevented.

SUMMARY OF THE INVENTION

The object of the invention is to create an insole both suitable for massaging the reflex zones of the foot-sole and simpler to manufacture than heretofore.

Based on the initially discussed insole, the solution of the invention provides that the base-sole and the elevations are uniformly made of a foam with a shore hardness A of 30° to 45° and in that the peak regions of the elevations project by the mean thickness or twice the mean thickness of the adjoining base-sole areas above the upper side of the base-sole.

Surprisingly it was found that the highly effective reflex-zone massaging of the foot-sole described in the German patent 35 08 582 which is caused by comparatively elastic cushion-elevations, without the comfort being degraded by harder elevations causing pressure points, also can be achieved when matching the peak regions of the elevations in such manner to the thickness of the base-sole that on one hand elastic behavior shall be retained while on the other hand compression of the foot-sole by the elevations shall be precluded. In deviation from the elevations of the German patent 35 08 582, the elevations are comparatively shallow and will reach their full height massaging the foot-sole in the area of the reflex zones only after the areas surrounding the base-sole have been compressed, while ensuring a massage free of pressure points on account of the also elastic total height. The cushion-elevations and the base-sole having being integrally manufactured from a uniform foam, the insoles of the invention are easily produced using conventional foam-body manufacturing-methods. Herein the average mean of the thickness along the elevation edges shall denote the average thickness of the base-sole areas adjoining the individual elevations. The thickness may vary, for instance when the upper side of the base-sole is trough-shaped in the manner of a foot-sole. The insole may be insertable or be firmly bonded to the inner sole or tread of the shoe. It is understood herein also that the upper side of the insole may be fitted with a cover sole improving the appearance or the wear of the shoe.

Reflex-zone massaging will be optimal when the peak regions of the elevations shall project by about one-and-a-half the mean thickness of the base-sole areas adjoining the individual elevations above the upper side of the base-sole. Advantageous uniform massaging also will be achieved when the total height of the base-sole, including the elevations at the peak regions of all elevations shall be substantially equally large.

In similarity with the insole of the German patent 35 08 582, the elevations may assume an approximately lenticular shape. Improved matching of the peak height of the elevations to the size of the reflex-zones to be stimulated can be achieved when at least part of the elevations assume circular contours and comprises a peak region in the form of a flat plateau which flares in frustoconical manner toward the base-sole. The peak plateau ensures an enlarged rest surface for the foot-sole on the elevation without one or more point rest-surfaces being produced that might form compression sites.

In a preferred embodiment mode the base-sole thickness in the areas adjoining the elevations shall be between 1.5 and 2.5 mm. This size leads to optimal elasticities of the elevations on one hand and on the other to optimal mechanical strength of the base-sole.

BRIEF DESCRIPTION OF THE DRAWINGS

An illustrative embodiment of the invention is elucidated below in relation to the drawings.

DETAILED DESCRIPTION OF THE PREFERRED EMBODIMENT

Figure 1:
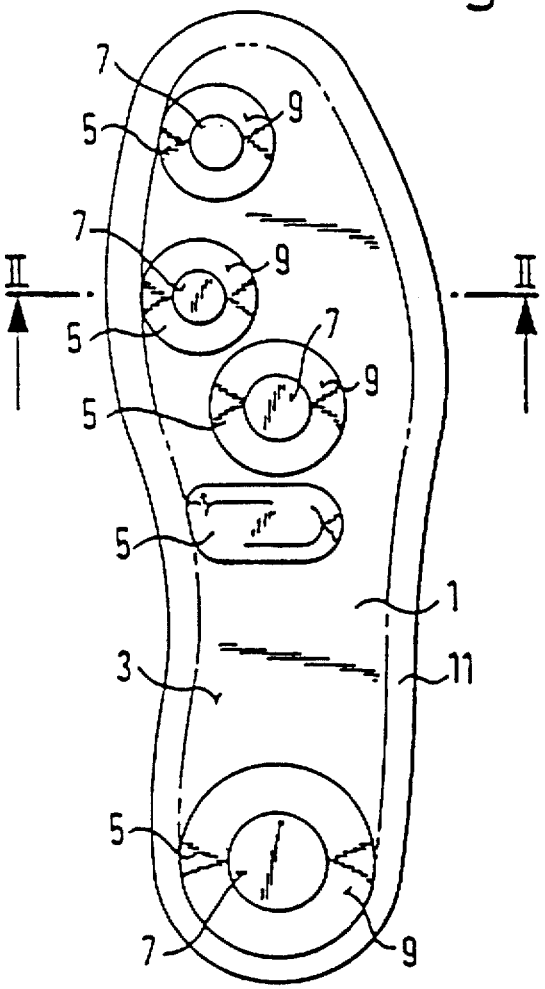
FIG. 1 is a topview of the upper side of an insole of the invention.

A plurality of reflex zones can be defined on the human foot-sole, of which each is associated to different organs that shall be stimulated when the reflex-zones are being massaged. The stimulation may be carried out by massaging individual reflex zones or by massaging suitably selected sets of reflex zones in order to enhance the stimulation is effect as a whole.

The shoe insole shown in the Figures allows controlled massaging of a set of reflex-zones enhancing general well-being. The insole comprises a base-sole 1 approximately matching the contour of the foot or shoe, cushion-like elevations 5 associated to the reflex-zones to be massaged projecting from the upper side 3 of said base-sole 1. The elevations 5 allow gentle massaging, free of pressure points, of the reflex zones to which they are associated. For that purpose the base-sole 1 and the elevations 5 integral with it consist uniformly of a rubber-elastic foam with a shore hardness A of about 30° to 45°. Along the periphery of the elevations 5, the thickness of the base-sole is about 1.5 to 2.5 mm, whereas the elevations 5 project by about 1.5-fold the mean thickness measured along the outer rim of the individual elevation 5 above the base-sole 1. The total height of the base-sole 1 plus the elevation 5 is essentially the same at the peak regions 7 of all elevations. At least part of the elevations evince circular contours, the peak region 7 of these elevations being formed as a flat, especially a plane plateau in order to increase the rest surface flaring downward as a frustrum-of-cone 9 toward the base-sole 1. However the elevations also may assume other contours in the manner indicated by the elongated elevation transverse to the foot longitude and present in the arch zone. Illustratively this elevation stimulates the pancreas.

Figure 2:
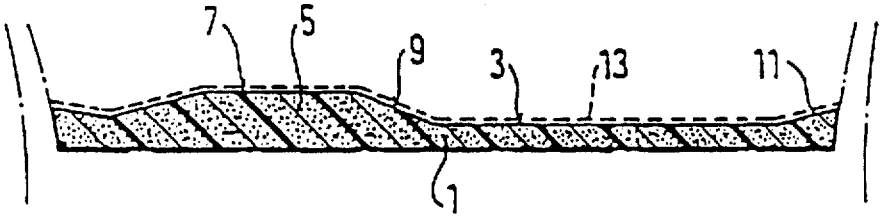
FIG. 2 is a cross-sectional view of the insole along a line II—II of FIG. 1.

As shown most clearly by FIG. 2, the base-sole 1 comprises a rim 11 minutely rising outward along its contour and as a result this base-sole assumes the property of a slight foot-bed. As indicated in FIG. 2 at 13, the upper side may hold a thin cover sole improving the appearance or the wear-properties of the shoe. The insole may be designed as an insole insertable into the shoe, or it may be bonded across its surface to the inner sole or the tread of the shoe.

Preferably the insole shall consist of synthetic latex to prevent allergic reactions as much as possible.

Figure 3:
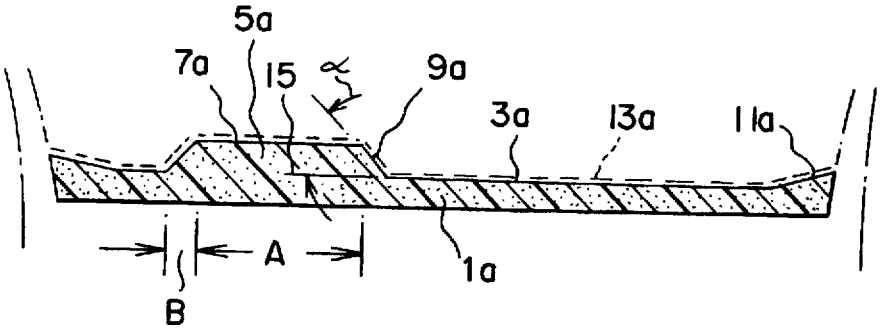
FIG. 3 is a cross-sectional view, similar to FIG. 2, but illustrating a different embodiment of the invention.

FIG. 3 is a section similar to FIG. 2, and shows a variation of the insole elucidated above in relation to FIGS. 1 and 2. The components corresponding to the insole of FIGS. 1 and 2 are fitted with the same references. However to distinguish the references, they are provided with the letter "a". The explanation for FIGS. 1 and 2 holds for this case too.

The insole of FIG. 3 includes a base sole la evincing cushion-shaped elevations 5*a* projecting from its upper side 3*a* toward the reflex zones to be massaged. The elevations 5*a* comprise peak regions 7*a* in the form of essentially flat, preferably planar plateaux adjoined by slope zones 9*a* descending toward the base sole 1*a* and enclosing the peak regions 7*a*. As already described, at least part of the elevation 5*a* may assume circular contours; however, other contours, in particular elongated ones, could be advantageous in specific cases. Moreover, the base sole la may be in the nature of foot-bed; it may be fitted along its contour with an edge 11*a* rising outwardly and where called for it may be fitted at its top side 3*a* with a thin covering sole 13*a*.

The reflex zones of the human foot-sole are locally bounded. Being specifically related to individual organs of the human body, it will be desirable that they shall be stimulated in a controlled manner by the reflex-zone massaging. Accordingly, the elevations 5 as well as 5*a* evince sizes and positions approximately matching the sizes and positions of the reflex zones to be massaged. Contrary to the case of reflex-zone massaging therapy of only short duration, it is the object of the invention that the shoe fitted with the insole of the invention also can be borne over extended periods, where called for steadily. Because the individual elevations 5 and 5*a* evince flat, plateau-shaped peak regions 7 and 7*a* respectively. They are able to comfortably support the foot-sole at the reflex zones also for constant use. As best illustrated by FIG. 3, the peak regions 7*a* are of a length A along the base sole 1*a*, said-length A being larger than the width B of the slope zone 9*a* adjoining the peak regions 7*a*. In this manner a comparatively narrow contour of the elevations may be preserved which in turn allows controlled massaging of the associated reflex zones.

When walking, the foot-sole detaches in rolling manner from the insole. The longer the peak region 7*a* remains in massaging contact with the associated reflex zone, the more effectively the organs related to the reflex zones shall be stimulated. As already explained, the slope zone 9*a* therefore is made narrower than the plateau region. However it was discovered, surprisingly, that the slope zone 9*a* may not be shortened arbitrarily. In other words, the slope angle $\alpha$ at which the generatrix of the slope zone 9*a* is slanted relative to a plane 15 extending at least approximately parallel to the upper side 3*a* cannot exceed a predetermined maximum value. It was found that the slope angle $\alpha$ of the slope region 9*a* may not exceed a value from 25° to 65° and that furthermore beyond said value, the slope region 9*a* must be slanting in this angular range over at least part of its slope. A slope angle in the vicinity of 45° extending over the entire slope height of the slope region 9*a* was found especially applicable. In specific cases there may also be more shallow transitions at the foot and top of the slope region 9*a*. Because of the above magnitude of the slope angle $\alpha$, disadvantageous reduction of the area of the peak region 7*a* is averted on one hand, and on the other excessively steep slope regions 9*a* are precluded so that the edges of the reflex zones cannot be over-stimulated, which would be a drawback for stimulation.

The elevations 5*a* of the insole shown in FIG. 3 also are integral with the base sole 1*a* and they consist uniformly of a material evincing rubbery elasticity with a hardness between at least 25 to 30 Shore A and a maximum of 40 to 45 Shore A. The material may be solid and elastic like rubber, preferably however it shall be an elastic foam material such as latex. The material dimensioned in the above manner evinces a hardness substantially corresponding to that of the foot-sole skin. It was found that optimal massaging can be achieved by matching the material stresses in this manner.

Furthermore the insole of FIG. 3 may be designed in the manner of the embodiment mode of FIGS. 1 and 2 so that the peak regions 7*a* of the elevations 5*a* project beyond the upper side 3*a* of the base sole 1*a* by once to twice the mean thickness of the areas of the said base sole 1*a* that adjoin the individual elevations 5*a*. Because of the specific selection of the slopes of the slope zones 9*a* however, dimensions deviating from this rule also may be adopted without thereby lowering the massaging effectiveness.

I claim:

1. A method of selectively massaging at least one reflex zone of a foot-sole of a shoe wearer, comprising (a) providing a shoe insole comprising:

a flat base-sole corresponding to a shoe contour, said shoe insole being made of a single piece of foam with a shore hardness A of 30° to 45°, said shoe insole comprising a plurality of integral cushion-elevations formed thereupon, with each of said cushion-elevations comprising an elevation section which gradually increases in thickness from a surface of said base-sole to a peak region which comprises a thickest portion of each cushion-elevation, and wherein each of said elevation sections fully encompasses one corresponding peak region, each peak region comprising an essentially flat plateau area which forms a rest surface upon which a foot-sole can rest, said peak regions projecting upward from the base-sole by a thickness which is up to twice a mean thickness of an area of the base-sole adjoining the cushion-elevations, wherein a first circular flat plateau area, fully encompassed by said elevation section, is formed in a heel region of said insole, wherein a second circular flat plateau area, fully encompassed by said elevation section, is formed in a toe region of said insole, and wherein a third circular flat plateau area, fully encompassed by said elevation section, and a fourth elongated flat plateau area, fully encompassed by said elevation section, are formed in a mid region of said insole between said heel region and said toe region, (b) contacting the shoe insole with the foot-sole, and (c) applying pressure to the shoe insole with the foot-sole to selectively massage at least one reflex zone of the foot-sole.

2. The method defined in claim 1, wherein the shoe insole is provided as an insole insertable into a shoe, and the insole is inserted into the shoe by the shoe wearer.

3. The method defined in claim 1, wherein the shoe insole is provided in a shoe.

4. A method of selectively massaging at least one reflex zone of a foot-sole of a shoe wearer, comprising (a) providing a shoe insole comprising:

a flat base sole made of an elastic foam with a shore hardness of 30° to 45° and corresponding to a shoe contour, and several elevations consisting of said foam and integral with the base sole and on a foot use side of said base sole, said elevations being in a vicinity of selected reflex zones of a foot-sole, and comprising essentially flat peak regions in the form of plateaus to support the foot-sole and descending in the form of slopes from all sides of said plateaus toward the base sole, said essentially flat peak regions projecting by up to twice a mean thickness of base sole regions adjoining the individual elevations above the foot use side of the base sole and each peak region being of a dimension along the base sole exceeding the dimension along the base sole of the slope zone adjoining the peak region, wherein said several elevations comprise a first elevation having a circular plateau disposed in a heel region, a second elevation having a circular plateau disposed in a toe region, a third elevation having a circular plateau disposed in a mid region and a fourth elevation having an elongated plateau disposed in said mid region, wherein said mid region is disposed between said heel region and said toe region, (b) contacting the shoe insole with the foot-sole, and (c) applying pressure to the shoe insole with the foot-sole to selectively massage at least one reflex zone of the foot-sole.

5. The method defined in claim 4, wherein the shoe insole is provided as an insole insertable into a shoe, and the insole is inserted into the shoe by the shoe wearer.

6. The method defined in claim 4, wherein the shoe insole is provided in a shoe.

7. The method defined in claim 4, wherein the thickness of the base-sole in areas adjoining the elevations is between 1.5 and 2.5 mm.

8. The method defined in claim 4, wherein the elevations descend in approximately frusto-conical manner toward the base sole.

9. The method defined in claim 1, wherein said peak regions project upward from base-sole by a thickness which is up to about 1½ the mean thickness of an area of the base-sole adjoining the cushion-elevations.

10. The method defined in claim 4, wherein said essentially flat peak regions project by up to about 1½ the mean thickness of base sole regions adjoining the individual elevations above the foot use side of the base sole.

11. A method of selectively massaging at least one reflex zone of a foot-sole of a shoe wearer, comprising (a) providing a shoe insole comprising a flat base sole corresponding to a shoe contour, made of an elastic material with a shore hardness A between at least 25° to 30° and a maximum of 40° to 45° A, and several elevations integral with the base sole and of the same material and present at a top side of the base sole as seen in use, said elevations being present in a vicinity of selected reflex zones of a foot-sole and comprising essentially flat peak regions in the form of plateaus to support the foot-sole and descending by slope zones toward the base sole, each plateau size being larger than the width of the slope zone fully enclosing the plateau, a maximum angle between a surface of the slope zone fully enclosing the elevation and a plane substantially parallel to the upperside of the base sole being between 30° and 60°, wherein said several elevations comprise an elevation having a circular plateau disposed in a heel region, an elevation having a circular plateau disposed in a toe region, an elevation having a circular plateau disposed in a mid region and an elevation having an elongated plateau disposed in said mid region, wherein said mid region is disposed between said heel region and said toe region, (b) contacting the shoe insole with the foot-sole, and (c) applying pressure to the shoe insole with the foot-sole to selectively massage at least one reflex zone of the foot-sole.

12. The method defined in claim 11, wherein the shoe insole is provided as an insole insertable into a shoe, and the insole is inserted in the shoe by the shoe wearer.

13. The method defined in claim 11, wherein the shoe insole is provided in a shoe.

14. The method defined in claim 11, wherein the maximum angle evinced between the at least a part of the slope zone and the plane is between 40° and 50°.

15. The method defined in claim 11, wherein the elastic material is a foam and has a shore hardness A of 30° to 45°.

16. The method defined in claim 11, wherein the elevations descend in approximately frusto-conical manner toward the base sole.

17. A method of selectively massaging at least one reflex zone of a foot-sole of a shoe wearer, comprising (a) providing a shoe insole comprising:

a flat base-sole corresponding to a shoe contour, said shoe insole being made of a single piece of an elastic material, said shoe insole comprising a plurality of integral cushion-elevations formed thereupon, with each of said cushion-elevations comprising an elevation section disposed completely within said base sole and a plateau section, wherein said elevation section fully encompasses said plateau region and increases in thickness from a surface of said base-sole to said plateau region, wherein said plurality of integral cushion-elevations comprises a first cushion-elevation wherein said plateau region has a first peripheral shape and a second cushion-elevation wherein said plateau region has a second peripheral shape, wherein said base-sole has an upper side which forms a foot-sole contacting region of a shoe, (b) contacting the shoe insole with the foot-sole, and (c) applying pressure to the shoe insole with the foot-sole to selectively massage at least one reflex zone of the foot-sole.

18. The method defined in claim 17, wherein the shoe insole is provided as an insole insertable into a shoe, and the insole is inserted into the shoe by the shoe wearer.

19. The method defined in claim 17, wherein the shoe insole is provided in a shoe.

20. The method defined in claim 17, wherein said first and second cushion-elevations are disposed in a mid region of said base-sole, wherein said mid region is disposed between a heel region and a toe region of said base-sole.

21. The method defined in claim 17, wherein said shoe insole comprises a piece of foam with a shore hardness A of 30° to 45°.

* * * * *